United States Patent [19]

Ishihara et al.

[11] Patent Number: 4,917,424

[45] Date of Patent: Apr. 17, 1990

[54] HANDLE DEVICE OF LID OPENER MECHANISM

[75] Inventors: Hiroshi Ishihara, Kariya; Kimiharu Hirose, Obu, both of Japan

[73] Assignee: Aisin Seiki Kabushiki Kaisha, Japan

[21] Appl. No.: 166,423

[22] Filed: Mar. 10, 1988

[30] Foreign Application Priority Data

| | | | |
|---|---|---|---|
| Mar. 11, 1987 | [JP] | Japan | 62-035273[U] |
| Mar. 23, 1987 | [JP] | Japan | 62-042302[U] |
| Mar. 26, 1987 | [JP] | Japan | 62-044557[U] |
| Mar. 27, 1987 | [JP] | Japan | 62-046143[U] |
| Mar. 30, 1987 | [JP] | Japan | 62-047022[U] |
| Mar. 30, 1987 | [JP] | Japan | 62-047026[U] |

[51] Int. Cl.[4] ..... E05C 21/00

[52] U.S. Cl. ..... 292/336.3; 292/DIG. 38

[58] Field of Search ..... 292/28, 50, 125, 225, 292/336.3, DIG. 38, DIG. 53

[56] References Cited

U.S. PATENT DOCUMENTS

| | | | |
|---|---|---|---|
| 4,346,925 | 8/1982 | Okada | 292/336.3 |
| 4,544,189 | 10/1985 | Fiordellisi et al. | 292/50 |
| 4,566,350 | 1/1986 | Miyamoto et al. | 292/DIG. 38 X |
| 4,585,258 | 4/1986 | Mochida | 292/125 |

FOREIGN PATENT DOCUMENTS 59-57669 7/1984 Japan .

*Primary Examiner*—Richard E. Moore

*Attorney, Agent, or Firm*—Finnegan, Henderson, Farabow, Garrett & Dunner

[57] ABSTRACT

In a lid opener mechanism having two locking devices for respectively locking two lids such as a fuel lid and a trunk lid of a motor vehicle, a handle device is provided for operating the control wires connected to each lid. The handle device includes a support on which are mounted for rotation two separately moveable levers. Each lever is spring biased to return it to its rest position after use and thereby permit closure of the lid which has been opened. Both levers are rotatably mounted in parallel on a projection extending out from the base of the handle device. Another projection, formed on the outer lever passes through said first projection and connects to the base. This arrangement assists in preventing rattles that might otherwise occur.

8 Claims, 5 Drawing Sheets

HANDLE DEVICE OF LID OPENER MECHANISM

BACKGROUND OF THE INVENTION

1. Field of the Invention

The present invention relates to an opener for opening lids such as a fuel lid and a trunk lid in a motor vehicle.

2. Prior Art of the Present Invention

A conventional opener for opening lids is disclosed, for example, in Japanese Utility Model Laid-Open Publication No. 59-57669 which is published without examination under the date of Apr. 14, 1984. The opener includes a base member fixed to a vehicle body and a pin member fixedly connected at one end portion thereof to the base member. Between a flange formed at the other end portion of the pin member and the base member, a set of adjoined levers are rotably mounted on the pin member. One of the levers is operatively connected to a trunk lid of the vehicle body and the other lever is operatively connected to a fuel lid of the vehicle body. However, since one end portion of the pin member is flattened and retained by the base member, the pin member is subject to moving in an oscillating manner about the one end portion thereof. Thus, rattles are generated between the pin member and each lever.

SUMMARY OF THE INVENTION

It is, therefore, a principal object of the present invention to provide an opener without the afore-mentioned drawback.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, the opener of this invention for opening individually two lids comprises, a base member including a connecting portion extending in a lateral direction, a supporting portion formed at one end portion thereof integrally with said connecting portion and extending in a longitudinal direction, an annular projection formed on said supporting portion and extending outwardly in a lateral direction, a bore formed in said annular projection and oriented in the axial direction thereof, a shoulder portion formed integrally with the other end portion of said supporting portion and extending outwardly in a lateral direction, and a pair of laterally spaced hooks formed on an upper side of said supporting portion, a first lever including a first main member adjoined to said supporting portion of said base member in parallel relationship thereto and having a hole through which said annular projection of said base member is rotably passed, a first knob formed at one end portion of said first main member, and a first pawl corresponding to one of said hooks and provided at the other end portion of said first main member, a second lever including a second main member adjoined to said first main member of said first lever in parallel relationship thereto and having an annular groove into which the distal end portion of said annular projection is rotably received, a second knob formed at one end portion of said second main member, and a second pawl corresponding to the other of said hooks, means for preventing extraction of said second lever from said annular projection of said base member, a first spring interposed between said first pawl of said first lever and one of said hooks; and (6) a second spring interposed between said second pawl of said second lever and the other of said hooks.

The accompanying drawings, which are incorporated in and constitute a part of this specification, illustrate one embodiment of the invention and, together with the description, serve to explain the principles of the invention.

DETAILED DESCRIPTION OF PREFERRED EMBODIMENT

Figure 1:
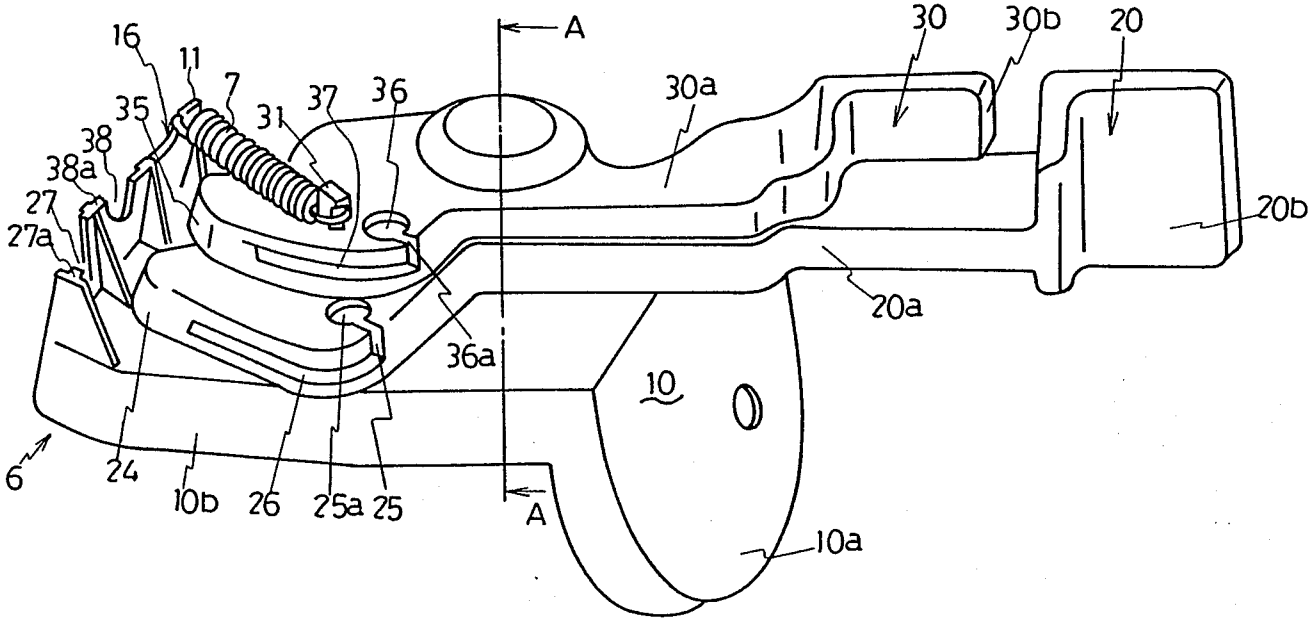
FIG. 1 is a perspective view of an opener according to the present invention looking upwardly.
Figure 2:
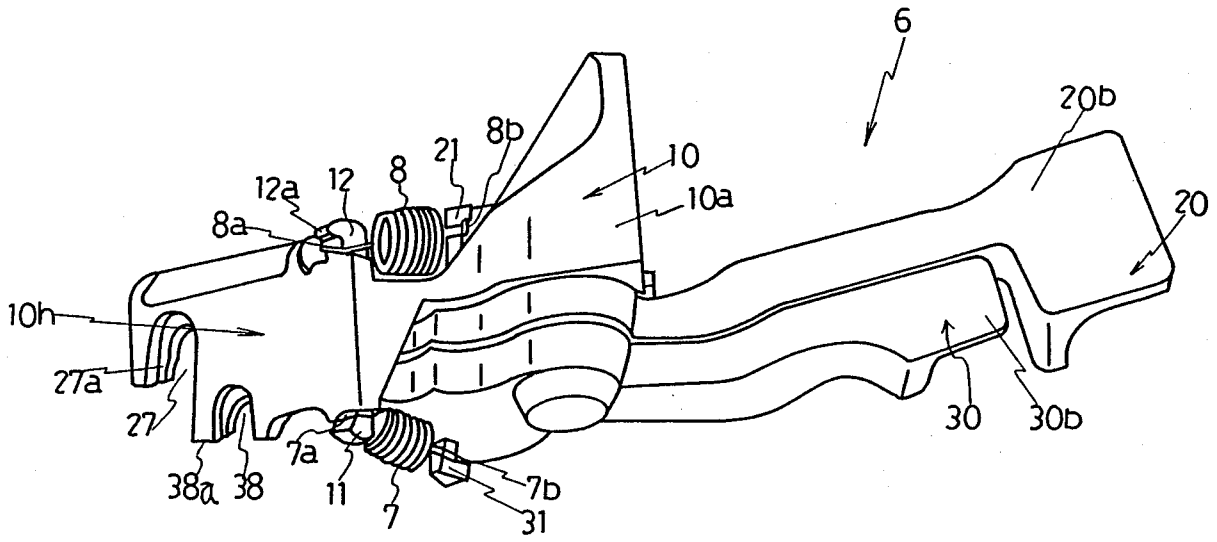
FIG. 2 is a perspective view of the opener according to the present invention looking downwardly.
Figure 3:
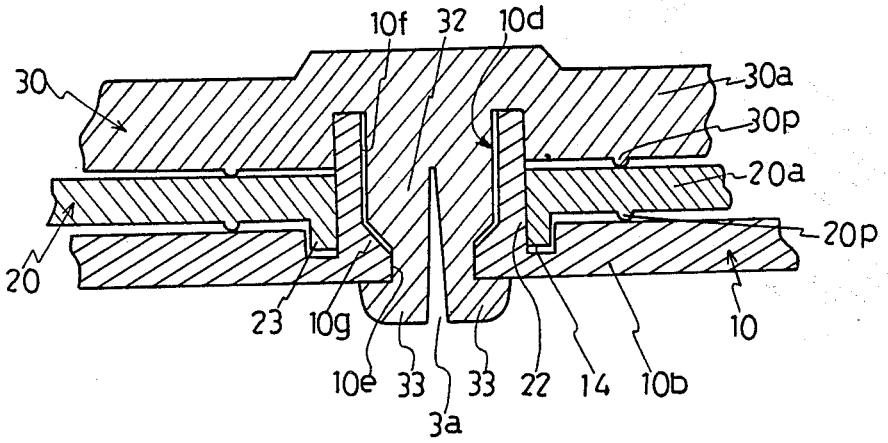
FIG. 3 is a partial cross-sectional view taken along line A—A in FIG. 1.

Referring now to FIGS. 1 through 3, an opener 6 includes a base member 10 having a connecting portion **10*a* which is extended in the lateral direction of a vehicle body (not shown) to be fixed thereto by a suitable means. The base member 10 further includes a supporting portion 10*b* which is formed integrally with the connecting portion 10*b* which is formed integrally with the connecting portion 10*a*. The supporting portion 10*b* is perpendicular to the connecting portion 10*a* and is extended backwardly in the longitudinal direction of said vehicle body. On the supporting portion 10*b*, there is formed an annular projection 10*c* which is extended outwardly in the lateral direction of the vehicle body. A bore 10*d*, which is formed through the annular projection 10*c*, is in the form of a stepped-configuration and has a smaller portion 10*e*, a larger portion 10*f* and a frustoconical portion 10*g* formed there between. The supporting portion 10*b* of the base member 10 is terminated in shoulder 10*h* having at upper side thereof a pair of laterally spaced hooks 11 and 12**.

A first lever 20 includes a main member **20*a* which is adjoined to the supporting portion 10*b* of the base member 10 in parallel relationship thereto. The main member 20*a* has a hole 22 through which the annular projection 10*c* is passed. Thus, the first lever 20 is mounted rotatably on the annular projection 10*c*. For smooth rotation of the first lever 20 on the base member 10, an annular prominence 20*p*, having an acute-angled shape in cross-section, is formed on the first lever 20. An annular projection 23 surrounding hole 22 is formed on the first lever 20 and is rotatably fitted in an annular groove 14. Groove 14 surrounds the annular projection 10*c* and is formed in the supporting portion 10*b* of the base member 10**.

At one end portion of the main member 20*a* of the first lever 20, there is formed a knob 20*b*. At the other end portion of the main member 20*a*, there is provided a pawl 21 which corresponds to the hook 12. Between the hook 12 and the pawl 21, there is disposed a first tension spring 8 so to permit closure of a trunk lid (not shown) via a first wire 40 which will be detailed later. In detail, each end portion 8*a*/8*b* is formed into a circular configuration. The hook 12 has a distal end portion 12*a* which is bent backwardly in the longitudinal direction of the vehicle body and the pawl 21 has a distal end portion 21*a* which is bent forwardly in the longitudinal direction of the vehicle body.

Figure 4:
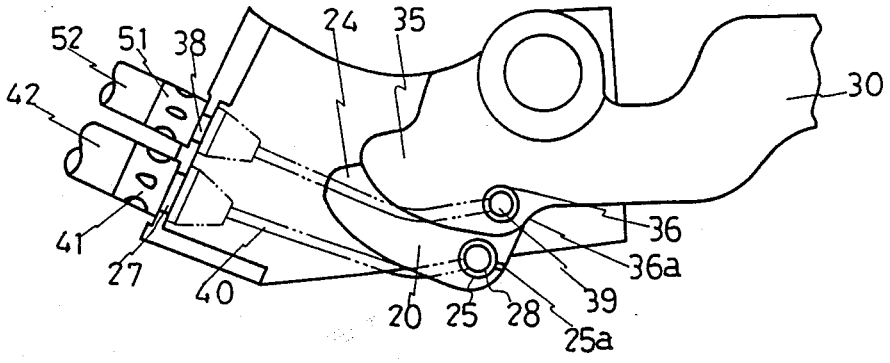
FIG. 4 is a view showing relationship between each wire and its corresponding lever in the opener.

At a lower side of the other end portion of the first lever 20, there is formed a blind-bore 25 and a longitudinal groove 26 in communication with each other via a cutout 25*a*. In the blind-bore 25, a pin 28 (FIG. 4) connected to a right end portion of the first wire 40 is snugly fitted. The first wire 40 is loosely inserted in the groove 26 so as to be guided therein the first wire 40 is also guided through a tube 42 clamped into a first recess 27 formed at an outer surface of the shoulder portion 10*b*.

A second lever 30 includes a main member 30*a* which is adjoined to the main member 20*a* of the first lever 20 in parallel relationship thereto. The main member 30*a* has an annular groove 34 (FIG. 3) for receiving the annual projection 10*c* of the base member 10. A projection 32 of the second lever 30 is passed through the stepped bore 10*d*. An axial groove 39 is formed in a distal end portion of the projection 32, thereby giving elasticity thereto. Resulting or separated portions 33,33 are engaged with the base member 10. Thus, the second lever 30 is mounted rotatably on the annular projection 10*c*. For smooth rotation of the second lever 30 on the first lever 20, an annular prominence 30*p* having an acute-angled shape in cross-section is formed on the second lever 30.

Figure 5:
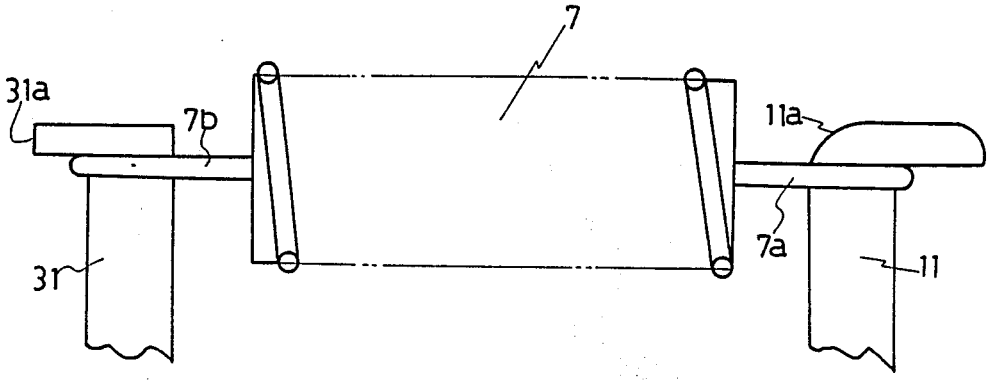
FIG. 5 is a view showing spring and adjacent structure.

At one end portion of the main member 30*a* of the second lever 30, there is formed a knob 30*b*. At the other end portion of the second lever 30, there is provided a pawl 31 which corresponds to the hook 11. Between the hook 11 and the pawl 31, there is disposed a second tension spring 7 so as to permit closure of a fuel lid (not shown) via a second wire 50 which will be detailed later. In detail, each end portion 7*a*/7*b* is formed into a circular configuration. The hook 11 has a distal end portion 11*a* which is bent backwardly in the longitudinal direction of the vehicle body and the pawl 31 has a distal end portion 31*a* which is bent forwardly in the longitudinal direction of the vehicle body. In spite of sliding movement of each end portion 7*a*/7*b* of the second spring 7, engagement is assured between the spring and each distal end portion 11*a*/31*a* of the hook 11/pawl 31 (FIG. 5).

At a lower side of the other end portion of the second lever 30, there is formed a blind-bore 36 and a longitudinal groove 37 in with each other via a cutout 36*a*. In the blind-bore 36, a pin 39 (FIG. 4) connected to a right end portion of the second wire 50 is snugly fitted. The second wire 50 is loosely inserted in the groove 37 so as to be guided therein. The second wire 50 is also guided through a tube 52 clamped into a first recess 38 formed at an outer surface of the shoulder portion 10*c*.

Figure 6:
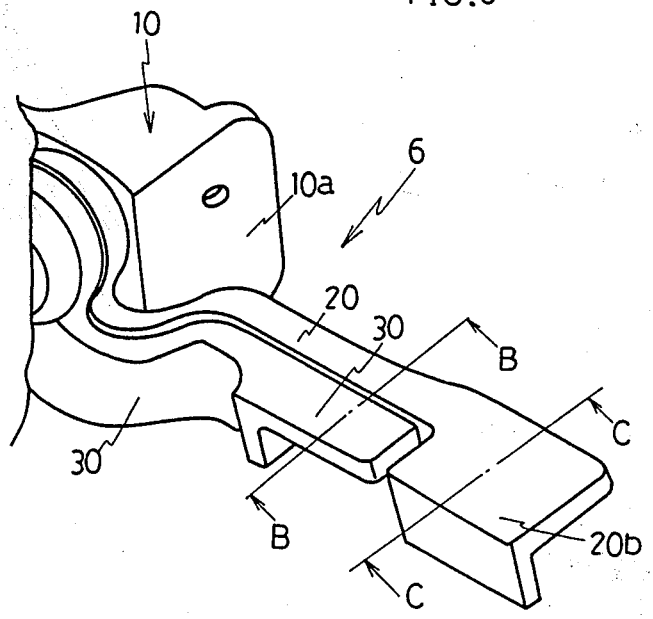
FIG. 6 is a perspective view showing each lever and its knob.
Figure 7:
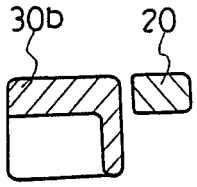
FIG. 7 is a cross-sectional view taken along line B—B in FIG. 6.
Figure 8:
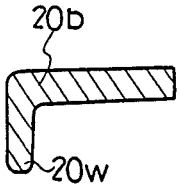
FIG. 8 is a cross-sectional view taken along line C—C in FIG. 6.
Figure 9:
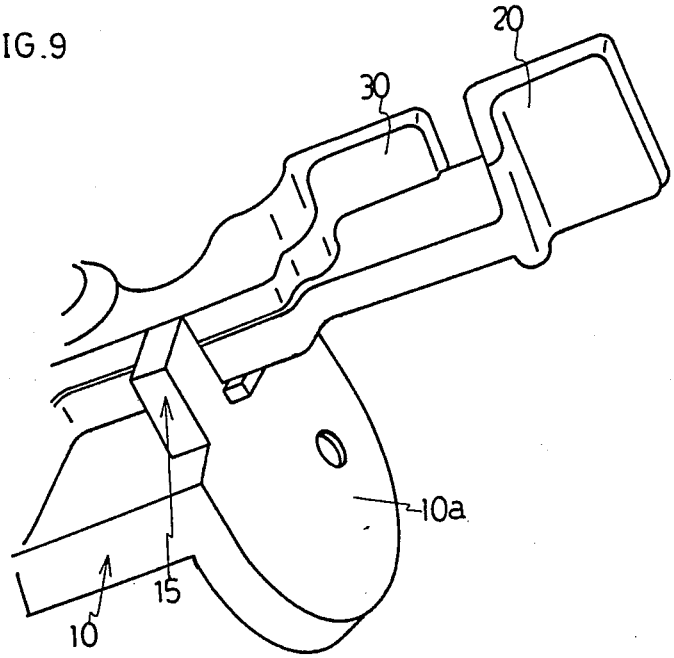
FIG. 9 is a view showing another opener having a stopper.

For preventing mis-selection of the knob 20*b* of the first lever 20 for the knob 30*b* of the second lever 30, as shown in FIGS. 6 through 8, a portion 30*h* to be held by a driver's fingers is oriented outwardly in the lateral direction of the vehicle body as well as a portion 20*h* to be held by a driver's fingers is oriented forwardly in the longitudinal direction of the vehicle body. Further, so as to prevent excess rotation of each lever 20/30, a stopper 15 may be formed to the connecting portion 10*a* of the base member 10 as shown in FIG. 9.

What is claimed is:

1. An opener for opening individually two lids of a vehicle comprising:

(1) a base member including a connecting portion extending in a lateral direction, a supporting portion formed at one end portion thereof integrally with said connecting portion and extending in a longitudinal direction, an annular projection formed on said supporting portion and extending outwardly in a lateral direction, a bore formed in said annular projection and oriented in the axial direction thereof, a shoulder portion formed integrally with the other end portion of said supporting portion and extending outwardly in a lateral direction, and a pair of laterally spaced hooks formed on an upper side of said supporting portion;

(2) a first lever including a first main member adjoined to said supporting portion of said base member in parallel relationship thereto and having a hole through which said annular projection of said base member is rotatably passed, a first knob formed at one end portion of said first main member, and a first pawl corresponding to one of said hooks and provided at the other end portion of said first main member;

(3) a second lever including a second main member adjoined to said first main member of said first lever in parallel relationship thereto and having an annular groove into which the distal end portion of said annular projection is rotatably received, a second knob formed at one end portion of said second main member, and a second pawl corresponding to the other of said hooks;

(4) means for preventing extraction of said second lever from said annular projection of said base member;

(5) a first spring interposed between said first pawl of said first lever and one of said hooks; and (6) a second spring interposed between said second pawl of said second lever and the other of said hooks.

2. An opener in accordance with claim 1 wherein said first main member of said first lever is formed with an annular prominence which is in sliding abutment on said connecting portion of said base member and said second main member of said second lever is formed with an annular prominence which is in sliding abutment on said first main member of said first lever.

3. An opener in accordance with claim 2 wherein the cross-section of each of said annular prominences is in the shape of an acute angle.

4. An opener in accordance with claim 1 wherein each end portion of each spring is formed in the configuration of a circle and engages with the hook or pawl.

5. An opener in accordance with claim 1 wherein a lower side of each lever is provided with a groove for guiding a corresponding wire.

6. An opener in accordance with claim 1 further comprising a first tube through which a first wire is passed and which is snugly fitted in a first recess formed at an outer surface of said shoulder portion and a second tube through which a second wire is passed and which is snugly fitted in a second recess formed at said outer surface of said shoulder portion.

7. An opener in accordance with claim 1 further comprising a stopper extending outwardly in the lateral direction for engagement by each lever to prevent excessive rotation thereof.

8. An opener in accordance with claim 1 wherein said knob of said first lever is oriented outwardly in the lateral direction and said knob of said second lever is oriented forwardly in the longitudinal direction.

* * * * *